United States Patent [19]

Jenkins

[11] Patent Number: 4,545,379

[45] Date of Patent: Oct. 8, 1985

[54] BODY COOLING DEVICE

[76] Inventor: John F. Jenkins, 103 S. Franklin Ave., Pleasantville, Pa. 08232

[21] Appl. No.: 579,379

[22] Filed: Feb. 13, 1984

[51] Int. Cl.[4] ..... A61F 7/00

[52] U.S. Cl. ..... 128/399; 62/259.3; 62/442; 98/41.1; 34/232

[58] Field of Search ..... 128/402, 400, 399, 401; 34/232, 243 R; 98/40 R, 40 C, 41 R; 165/65, 16; 62/259.3, 441, 442

[56] References Cited

U.S. PATENT DOCUMENTS

| | | | |
|---|---|---|---|
| 2,726,658 | 12/1955 | Chessey | 128/400 |
| 3,017,888 | 1/1962 | Weiner | 128/400 |
| 3,079,765 | 3/1963 | Vantine | 128/402 |
| 3,307,553 | 3/1967 | Liebner | 128/400 |
| 3,472,148 | 10/1969 | Winnett | 98/40 R |
| 3,656,541 | 4/1972 | Coyle et al. | 165/65 |
| 3,731,056 | 5/1973 | Becker | 165/65 |
| 3,869,871 | 3/1975 | Rybalko et al. | 128/399 |
| 3,885,571 | 5/1975 | Sachs | 128/400 |
| 3,897,790 | 8/1975 | Magilton et al. | 128/400 |
| 4,026,299 | 5/1977 | Sauder | 128/400 |
| 4,162,764 | 7/1979 | Millsap | 128/400 |
| 4,172,495 | 10/1979 | Zebuhr et al. | 128/402 |
| 4,259,961 | 4/1981 | Hood, III | 128/402 |
| 4,404,460 | 9/1983 | Kerr | 128/402 |

FOREIGN PATENT DOCUMENTS

| | | | |
|---|---|---|---|
| 573514 | 2/1958 | Italy | 62/259.3 |

*Primary Examiner*—Kyle L. Howell
*Assistant Examiner*—Ruth S. Smith
*Attorney, Agent, or Firm*—Robert K. Youtie

[57] ABSTRACT

A device for cooling the human body including a console having its interior communicating with a source of cooled and otherwise conditioned air, a seat adjacent to the console for supporting a user in sitting position with legs astride the console, the console having a face outlet opening upwardly from an upper region of the console for passing the conditioned air to a user's face, and the console having hand outlets opening upwardly from an upper region for passing conditioned air to a user's hands.

6 Claims, 2 Drawing Figures

BODY COOLING DEVICE

BACKGROUND OF THE INVENTION

As is well known, there are many human occupations and activities in which the participants become uncomfortably hot and would welcome temporary cooling, both for health, comfort and improved productivity. In sports an outstanding example is summer football, while in commerce it is known that steel mill workers would welcome such relief. While the device of the present invention has been primarily developed for use by athletes, it is appreciated that there are many other applications for use of the instant device, all of which are intended to become comprehended herein.

Applicant is aware of prior art listed below which is significant only in relating to the cooling of human or animal bodies.

| U.S. Pat. No. | PATENTEE |
|---|---|
| 2,726,658 | Chessey |
| 3,017,888 | Weiner |
| 3,307,553 | Liebner |
| 3,897,790 | Magilton et al. |
| 4,026,299 | Sauder |
| 4,162,764 | Millsap |

SUMMARY OF THE INVENTION

It is an important object of the present invention to provide a relatively simple and compact body cooling device which achieves a high degree of cooling effectiveness without appreciably altering the surrounding atmosphere.

It is another object of the present invention to provide a body cooling device which provides a high degree of satisfaction and comfort in a minimum of time by effectively cooling exposed body parts, particularly the hands, wrists and face, while providing conditioned breathing air for internal body cooling.

It is still another object of the present invention to provide a body cooling device of the type described which is substantially self contained, occupies a minimum of space, and affords cooling air flow to the user's hands and face.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
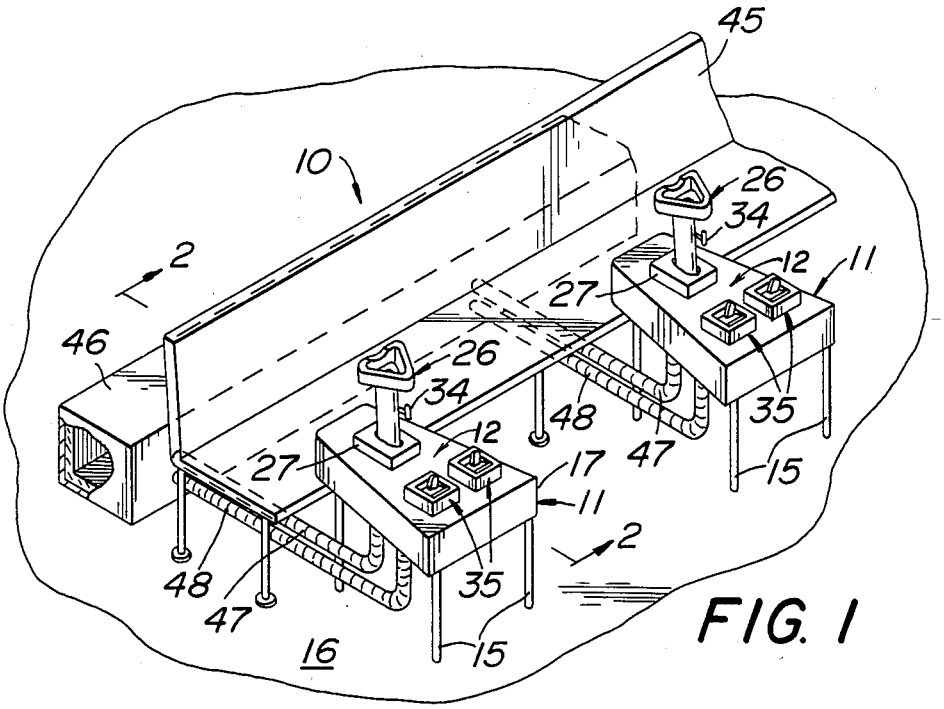
FIG. 1 is a top perspective view showing a body cooling device constructed in accordance with the teachings of the present invention.
Figure 2:
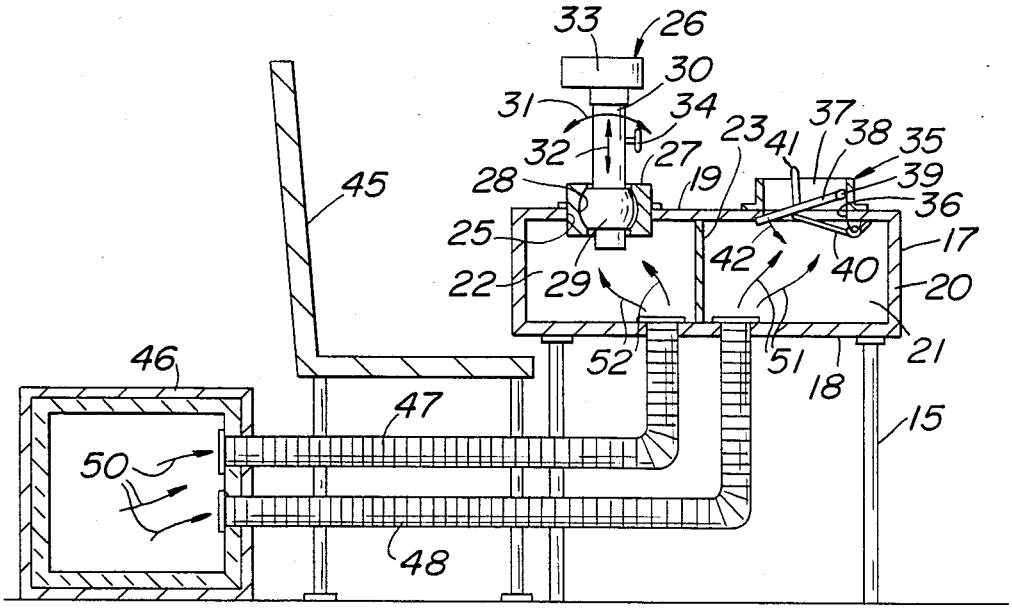
FIG. 2 is a sectional elevational view taken generally along the line 2—2 of FIG. 1.

Referring now more particularly to the drawings, and specifically to FIG. 1 thereof, the body cooling device of the present invention is there generally designated 10, and may include a hollow cabinet or console

11 having on its upper side an upwardly facing operating station 12.

More specifically, the console 11 may include upstanding legs or support means 15 adapted to rest on a ground, floor or other generally horizontal, upwardly facing supporting surface 16. Carried by the legs or support means 15 is an enclosure 17, which may be elongate in the forward and rearward direction, including a lower or bottom wall 18 supported on the legs 15, an upper or top wall 19 spaced over the bottom wall, and a peripheral side wall 20 extending between and about the peripheries of the bottom and top walls.

The interior of the enclosure 17 is subdivided into forward and rearward chambers or compartments 21 and 22 by an upright divider wall or partition 23 extending transversely or laterally across the enclosure interior. In the rearward region of the upper or top wall 19 there is formed a through opening 25 in which is mounted an outlet, diffuser or nozzle 26 communicating between the interior and exterior of the rear chamber 22 through the top enclosure wall 19. The outlet or nozzle 26 is advantageously selectively positionable to assume a desired direction. For example, the outlet 26 may include a generally annular bushing or mounting 27 having a contoured internal surface 28 and receiving an externally contoured collar 29 carrying a tube or conduit 30. Thus, the tube or conduit 30 is in fluid communication through the top wall 19 between the rear chamber 22 and the exterior thereof, and is arcuately swingable in the directions of arrows 31, while being longitudinally shiftable in the directions of arrows 32. The upper end of the outlet 26 may be provided with a dished member or face piece 33 for a generally conforming engagement with the human face. If desired, valve means 34 may be provided in the face outlet 26 to adjust fluid flow or close the same to fluid flow, as desired.

A pair of hand outlets 35 are located in side by side relation on the top enclosure wall 19 in the forward region thereof, and each may include a through opening or hole 36 in the top wall communicating between the forward enclosure chamber 21 and the exterior of the enclosure. Further, each outlet 35 may include a flanged nipple or ring 37 secured exteriorly on the top wall 19 generally congruent with a respective aperture or hole 36. Suitable valve means 38 may be mounted in each nipple or fitting 37, such as a closure plate hinged at 39 for swinging movement between the closed illustrated position and a downward swung open position. If desired, resilient means, such as a spring 40 may be mounted on the underside of enclosure top wall 19, adjacent to hand opening 36 and in bearing engagement with the underside of each valve plate 38 to resiliently urge the latter upward to a closed limiting position shown in FIG. 1. Manual actuating means, such as an upstanding hand engageable member 41 may be provided on each valve plate 38 extending upwardly therefrom beyond the fitting 37 when the valve plate is closed. The hand actuable member 41 may be manually depressed against the force of spring 40 to swing the valve plate 38 open in the direction of arrow 42, to any desired degree. Thus, the amount of conditioned air applied to the user's hands is selectively regulatable by hand operation of the actuating members 41.

There may be conveniently provided a bench or seat 45 extending transversely along and adjacent to the rearward region of the console 11. If desired, the bench 45 may be integral or firmly attached to the console 11 to resist relative movement therebetween. Also, a plurality of like consoles, such as the console 11, see FIG. 1, may be associated with the same bench 45, either separately or fixed thereto, as desired.

Of course, the enclosure 17 may be suitably insulated, or fabricated of insulating material, to obtain maximum operating efficiency.

Suitably located, say beneath or rearwardly of the bench 45 may be a conditioned air plenum or supply vessel 46, in fluid communication between the plenum or conditioned air supply 46 and the enclosure 17. In the illustrated embodiment the conduit, supply pipe or duct 47 communicates between the plenum 46 and the rear enclosure chamber 22, while the conduit, duct or pipe 48 communicates between the plenum and the forward enclosure chamber 21. The plenum 46 is, or course, connected to a suitable source of conditioned air, and air movement means, such as a blower, which may be conventional and therefore are not shown.

In operation, a user may be seated on the bench 45, or may stand if desired, with the left and right hands respectively on the actuating arms 41 of the valve means 38, and by selectively depressing either or both of the actuating arms a flow of cooled and conditioned air will pass through the desired hand outlet and at the desired rate to effectively cool one or both hands and wrists of the user. In addition, either simultaneously or sequentially, the user may locate his face adjacent to and facing toward the face piece 33, and selectively adjust the flow therefrom of conditioned air, as by controlling valve 34, to the user's face. While the face piece 49 may be utilized to obtain cool, conditioned breathing air for cooling the interior of the user's body, the face piece may also be used to cool the parts of the head, as desired.

Seen in the plenum 46 are arrows 50 indicating the direction of air flow from the plenum into the conduits 47 and 48, while additional arrows are shown in console chambers 21 and 22, as at 51 and 52 respectively, indicating the flow of conditioned air from the conduits 47 and 48 through the console chambers to the hand and face outlets. The separation of hand and face cooling into the two conduits 47 and 48 serve to substantially preclude any effect of hand and face cooling air through the hand and face outlets, one upon the other. The hand outlets 35 may be suitably sized to assure full hand cooling, including the wrists, for effective cooling of the veins adjacent to the skin. Also, the face outlet 26, and particularly its face piece 33 may be generally triangular or other suitable configuration, and dished or hollow for effectively communicating conditioned air to the nose and mouth of the user. Of course, the conditioned air may be filtered, as desired.

From the foregoing, it is seen that the present invention provides a body cooling device which is highly effective in operation, extremely simple in construction, durable and reliable throughout a long useful life, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A body cooling device comprising an elongated insulated enclosure having a hollow chamber for communcation with a source of conditioned air, an upwardly openable first outlet connected to and upstanding from an upper region of said enclosure adjacent to one enclosure end for passing conditioned air exteriorly of the chamber to a user's face, said first outlet including means adapted to position a user's face therein, said first outlet further including means adapted to be selectively positionable for passing air in a desired direction, a pair of additional upwardly opening outlets connected in an upper region of said enclosure adjacent to the other enclosure end for passng conditioned air exteriorly of the chamber to a user's hands, and valve means associated with said hand outlets for selectively opening and closing the latter.

2. A body cooling device according to claim 1, in combination with transverse dividing means for dividing said enclosure into separate chambers at opposite enclosure ends independently communicating with said first and additional outlets.

3. A body cooling device according to claim 2, said enclosure including a top wall, and said first and additional outlets being provided in said top wall.

4. A body cooling device according to claim 3, said valve means comprising normally closed resiliently biased valve elements in said additional outlets displaceable to open position by a user's hands over said additional outlets.

5. A body cooling device according to claim 4, in combination with a bench extending transversely of said enclosure adjacent to said one enclosure end, said first outlet being proximate to said bench and said additional outlets being remote from said bench, for use by a person seated on said bench with legs on opposite sides of said enclosure.

6. A body cooling device according to claim 5, in combination with a plenum rearwardly of said enclosure, and conduit means connected between said plenum and enclosure.

* * * * *